US009293124B2

(12) United States Patent
Billen et al.

(10) Patent No.: US 9,293,124 B2
(45) Date of Patent: Mar. 22, 2016

(54) TEMPO-ADAPTIVE PATTERN VELOCITY SYNTHESIS

(71) Applicant: GIBSON BRANDS, INC., Nashville, TN (US)

(72) Inventors: David Billen, Nashville, TN (US); Henry Juszkiewicz, Nashville, TN (US)

(73) Assignee: Gibson Brands, Inc., Nashville, TN (US)

( * ) Notice: Subject to any disclaimer, the term of this patent is extended or adjusted under 35 U.S.C. 154(b) by 150 days.

(21) Appl. No.: 14/161,227

(22) Filed: Jan. 22, 2014

(65) Prior Publication Data

US 2014/0202314 A1 Jul. 24, 2014

Related U.S. Application Data

(60) Provisional application No. 61/755,192, filed on Jan. 22, 2013.

(51) Int. Cl.

| | |
|---|---|
| ***G10H 7/00*** | (2006.01) |
| ***G10H 1/46*** | (2006.01) |
| ***G10H 1/00*** | (2006.01) |

(52) U.S. Cl.
CPC ..... *G10H 1/0008* (2013.01); *G10H 2220/081* (2013.01)

(58) Field of Classification Search
USPC ..... 84/609
See application file for complete search history.

(56) References Cited

U.S. PATENT DOCUMENTS

| | | | | |
|---|---|---|---|---|
| 4,982,642 | A * | 1/1991 | Nishikawa et al. | 84/484 |
| 6,576,826 | B2 * | 6/2003 | Kondo et al. | 84/615 |

* cited by examiner

*Primary Examiner* — Christopher Uhlir
(74) *Attorney, Agent, or Firm* — Bates & Bates, LLC

(57) ABSTRACT

A method of adjusting the presentation of music is provided. In the method, a sequence of musical notes is presented by a first music presenting device. A critical beat indicator defining a time within the sequence of musical notes for a critical beat point is received. An isolation indicator defining a period for note isolation for the sequence of musical notes is received. A velocity coefficient is calculated by a processor for each note of the sequence of musical notes. The velocity coefficient is calculated as a function of the defined time and the defined period for note isolation. The sequence of musical notes is presented by a second music presenting device using the calculated velocity coefficient.

20 Claims, 3 Drawing Sheets

TEMPO-ADAPTIVE PATTERN VELOCITY SYNTHESIS

CROSS-REFERENCE TO RELATED APPLICATION

This Application claims priority to U.S. Provisional Patent Application Ser. No. 61/755,192, filed Jan. 22, 2013, which is hereby incorporated by reference in its entirety.

TECHNICAL FIELD

The field of the disclosure relates generally to adjusting the presentation of musical sounds during the automatic generation of musical sounds from a musical score, and more particularly, to using a determined critical beat indicator to accent musical sounds similarly to how they would be accented during generation by a live musician.

BACKGROUND

The automatic generation of musical sounds from a musical score defined by a sequence of notes lacks variability. As a result, such automatically generated sound lacks the intonations that naturally result when different musicians add their own accent to the manner in which the notes are played.

SUMMARY

In an example embodiment, a method of adjusting the presentation of music is provided. In the method, a sequence of musical notes is presented by a first music presenting device. A critical beat indicator defining a time within the sequence of musical notes for a critical beat point is received. An isolation indicator defining a period for note isolation for the sequence of musical notes is received. A velocity coefficient is calculated by a processor for each note of the sequence of musical notes. The velocity coefficient is calculated as a function of the defined time and the defined period for note isolation. The sequence of musical notes is presented by a second music presenting device using the calculated velocity coefficient.

In another example embodiment, a computer-readable medium is provided having stored thereon computer-readable instructions that when executed by a device, cause the device to perform the method of adjusting the presentation of music.

In yet another example embodiment, a system is provided. The system includes, but is not limited to, a music presenting device, a processor and a computer-readable medium operably coupled to the processor. The computer-readable medium has instructions stored thereon that when executed by the processor, cause the system to perform the method of adjusting the presentation of music.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
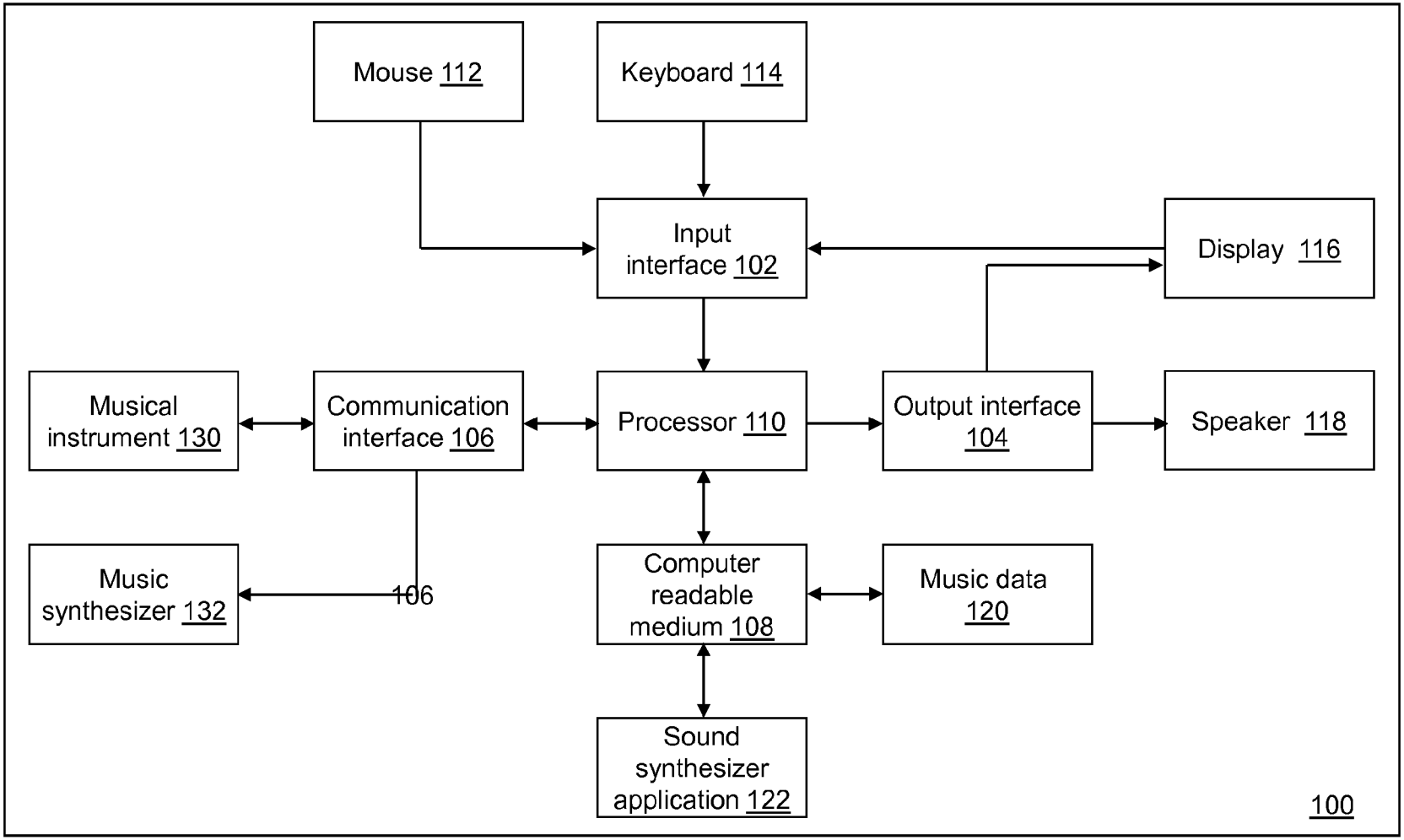
FIG. 1 depicts a block diagram of a music generation system in accordance with an illustrative embodiment.

With reference to FIG. 1, a block diagram of a music generation system 100 is shown in accordance with an illustrative embodiment. In the illustrative embodiment, music generation system 100 includes an input interface 102, an output interface 104, a communication interface 106, a computer-readable medium 108, and a processor 110. Fewer, different, and additional components may be incorporated into music generation system 100. The one or more components of music generation system 100 may be included in computers of any form factor such as a laptop, a server computer, a desktop, a smart phone, an integrated messaging device, a personal digital assistant, a tablet computer, etc.

Input interface 102 provides an interface for receiving information for entry into music generation system 100 as known to those skilled in the art. Input interface 102 may interface with various input devices including, but not limited to, a mouse 112, a keyboard 114, a display 116, a track ball, a keypad, one or more buttons, etc. that allow input of information into music generation system 100 automatically or under control of a user. Mouse 112, keyboard 114, display 116, etc. further may be accessible by music generation system 100 through communication interface 106. Display 116 may be a thin film transistor display, a light emitting diode display, a liquid crystal display, or any of a variety of different displays known to those skilled in the art. The same interface may support both input interface 102 and output interface 104. For example, a display comprising a touch screen both allows user input and presents output to the user. Music generation system 100 may have one or more input interfaces that use the same or a different input interface technology.

Output interface 104 provides an interface for outputting information from music generation system 100. For example, output interface 104 may interface with various output technologies including, but not limited to, display 116, a speaker 118, a printer, etc. Speaker 118 may be any of a variety of speakers as known to those skilled in the art. Music generation system 100 may have one or more output interfaces that use the same or a different interface technology. Speaker 118, the printer, etc. further may be accessible by music generation system 100 through communication interface 106.

Communication interface 106 provides an interface for receiving and transmitting data and messages between devices using various protocols, transmission technologies, and media as known to those skilled in the art. Communication interface 106 may support communication using various transmission media that may be wired or wireless. Music generation system 100 may have one or more communication interfaces that use the same or a different communication interface technology.

The components of music generation system 100 may be included in a single device and/or may be remote from one another. A network including one or more networks of the same or different types including any type of wired and/or wireless public or private network including a cellular network, a local area network, a wide area network such as the Internet, etc. may connect the components of music generation system 100 using communication interface 106. The one or more components of music generation system 100 may communicate using various transmission media that may be wired or wireless as known to those skilled in the art including as peers in a peer-to-peer network.

Computer-readable medium 108 is an electronic holding place or storage for information so that the information can be accessed by processor 110 as known to those skilled in the art. Computer-readable medium 108 can include, but is not limited to, any type of random access memory (RAM), any type of read only memory (ROM), any type of flash memory, etc. such as magnetic storage devices (e.g., hard disk, floppy disk, magnetic strips, . . . ), optical disks (e.g., CD, DVD, . . . ), smart cards, flash memory devices, etc. Music generation system 100 may have one or more computer-readable media that use the same or a different memory media technology. Music generation system 100 also may have one or more drives that support the loading of a memory media such as a CD or DVD. Computer-readable medium 108 further may be accessible by music generation system 100 through communication interface 106 and/or output interface 104.

Processor 110 executes instructions as known to those skilled in the art. The instructions may be carried out by a special purpose computer, logic circuits, or hardware circuits. Thus, processor 110 may be implemented in hardware, firmware, or any combination of these methods and/or in combination with software. The term "execution" is the process of running an application or the carrying out of the operation called for by an instruction. The instructions may be written using one or more programming language, scripting language, assembly language, etc. Processor 110 executes an instruction, meaning that it performs/controls the operations called for by that instruction. Processor 110 operably couples with input interface 102, with output interface 104, with computer-readable medium 108, and with communication interface 106 to receive, to send, and to process information. Processor 110 may retrieve a set of instructions from a permanent memory device and copy the instructions in an executable form to a temporary memory device that is generally some form of RAM. Music generation system 100 may include a plurality of processors that use the same or a different processing technology.

Music data 120 includes data defining a sequence of musical notes. Music data 120 may be stored in a variety of formats and include various data fields to define the note to be played which may include the pitch, the timber, the time, or any other note attribute for playing the note. Music data 120 may be stored in a database that may use various database technologies and a variety of different formats as known to those skilled in the art including a file system, a relational database, a system of tables, a structured query language database, etc. Computer-readable medium 108 may provide the electronic storage medium for music data 120. Music data 120 further may be stored in a single database or in multiple databases stored in different storage locations distributed over the network and accessible through communication interface 106 and/or output interface 104.

A sound synthesizer application 122 performs operations associated with generating sounds to be output using speaker 118, using a musical instrument 130, using a music synthesizer 132, etc. In the illustrative embodiment, musical instrument 130 and music synthesizer 132 are shown as accessible by processor 110 through communication interface 106 though in alternative embodiments, either or both may be accessible through input interface 102 and/or output interface 104. The operations may be implemented using hardware, firmware, software, or any combination of these methods. With reference to the example embodiment of FIG. 1, sound synthesizer application 122 is implemented in software (comprised of computer-readable and/or computer-executable instructions) stored in computer-readable medium 108 and accessible by processor 110 for execution of the instructions that embody the operations of sound synthesizer application 122. Sound synthesizer application 122 may be written using one or more programming languages, assembly languages, scripting languages, etc.

Sound synthesizer application 122 may be implemented as a Web application. For example, sound synthesizer application 122 may be configured to receive hypertext transport protocol (HTTP) responses from devices such as music generation system 100 and to send HTTP requests to devices such as music generation system 100. The HTTP responses may include web pages such as hypertext markup language (HTML) documents and linked objects generated in response to the HTTP requests. Each web page may be identified by a uniform resource locator (URL) that includes the location or address of the computing device that contains the resource to be accessed in addition to the location of the resource on that computing device. The type of file or resource depends on the Internet application protocol. The file accessed may be a simple text file, an image file, an audio file, a video file, an executable, a common gateway interface application, a Java applet, or any other type of file supported by HTTP. Thus, sound synthesizer application 122 may be a standalone program or a web based application.

If sound synthesizer application 122 is implemented as a Web application, a browser application may be stored on computer readable medium 108. The browser application performs operations associated with retrieving, presenting, and traversing information resources provided by a web application and/or web server as known to those skilled in the art. An information resource is identified by a uniform resource identifier (URI) and may be a web page, image, video, or other piece of content. Hyperlinks in resources enable users to navigate to related resources. Example browser applications include Navigator by Netscape Communications Corporation, Firefox® by Mozilla Corporation, Opera by Opera Software Corporation, Internet Explorer® by Microsoft Corporation, Safari by Apple Inc., Chrome by Google Inc., etc. as known to those skilled in the art. The browser application may integrate with sound synthesizer application 122. For example, sound synthesizer application 122 may be implemented as a plug-in.

Figure 2:
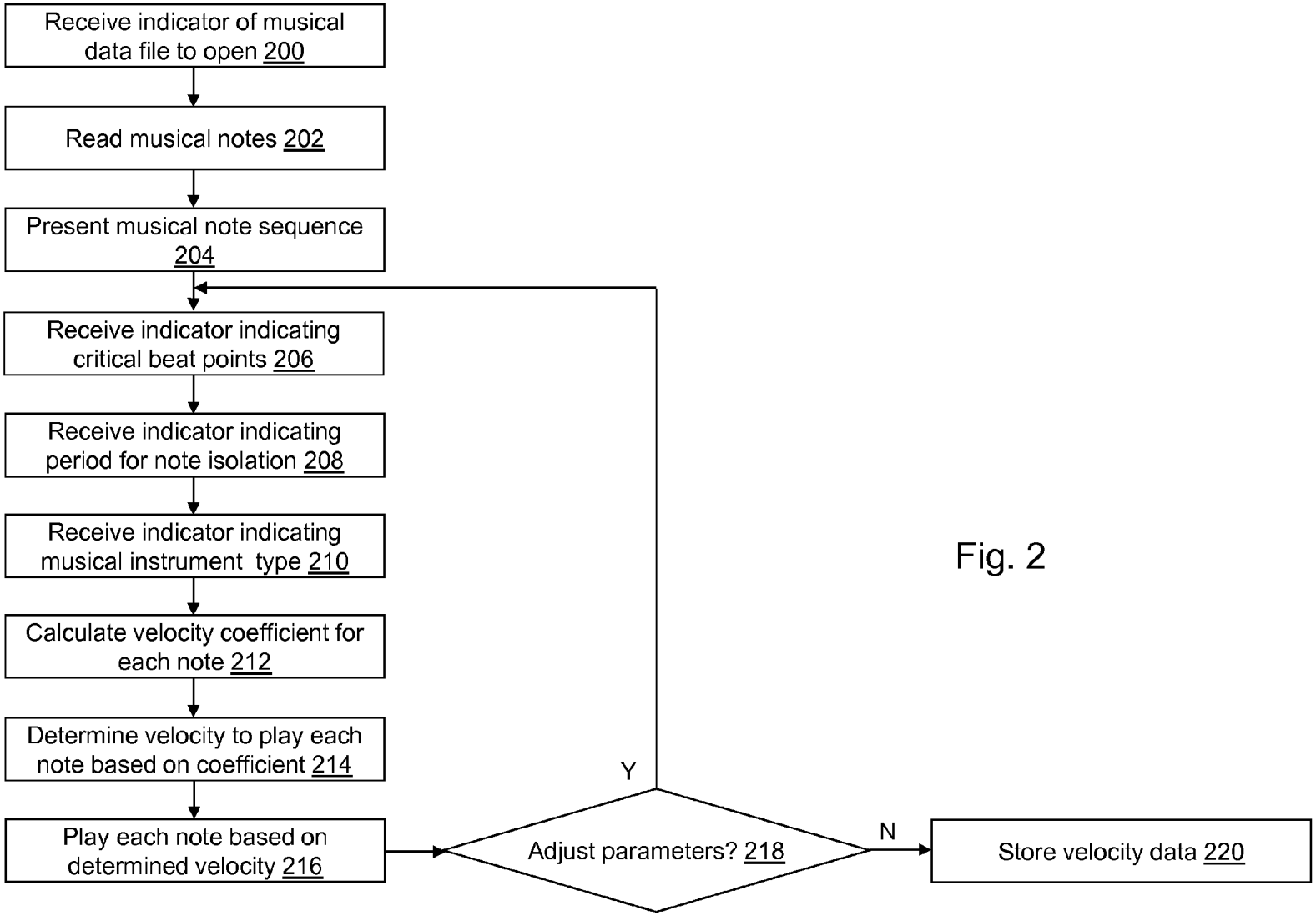
FIG. 2 depicts a flow diagram illustrating example operations performed by a sound synthesizer application executed by the music generation system of FIG. 1 in accordance with an illustrative embodiment.

With reference to FIG. 2, example operations associated with sound synthesizer application 122 are described. Additional, fewer, or different operations may be performed depending on the embodiment. For example, sound synthesizer application 122 may provide additional functionality beyond the capability to synthesize music. As an example, sound synthesizer application 122 may provide functionality to create music data 120 by allowing composition of the sequence of notes forming a musical score or by converting audio data, for example, from a CD or DVD, to music data 120 that may be in a different format.

The order of presentation of the operations of FIG. 2 is not intended to be limiting. A user can interact with one or more user interface windows presented to the user in display 116 under control of sound synthesizer application 122 independently or through use of the browser application in an order selectable by the user. Thus, although some of the operational flows are presented in sequence, the various operations may be performed in various repetitions, concurrently, and/or in other orders than those that are illustrated. For example, a user may execute sound synthesizer application 122, which causes presentation of a first user interface window, which may include a plurality of menus and selectors such as drop down menus, buttons, text boxes, hyperlinks, pop-up windows, additional windows, etc. associated with sound synthesizer application 122 as understood by a person of skill in the art.

The general workflow for sound synthesizer application 122 may be to create or open music data 120, to provide functionality to allow editing of music data 120, and to save or play music data 120 through speaker 118, musical instrument 130, or music synthesizer 132. Musical instrument 130 may be any type of electronically controllable musical instrument including drums, a piano, a guitar, a wind instrument, etc. Music synthesizer 132 may be any type of electrical or electomechanical device that synthesizes musical sounds from music data 120. As with any development process, operations may be repeated to develop music that is aesthetically pleasing as determined by the user of sound synthesizer application 122.

With continuing reference to FIG. 2, in an operation 200 an indicator is received by sound synthesizer application 122, which is associated with a request by a user to open a musical data file containing music data 120. For example, after the user accesses/executes sound synthesizer application 122, a first user interface window is presented on display 116 under control of the computer-readable and/or computer-executable instructions of sound synthesizer application 122 executed by processor 110 of music generation system 100. The first user interface window may allow a user to select the musical data file for opening. The musical data file may be a database. Of course, other intermediate user interface windows may be presented before the first user interface window is presented to the user. As another alternative, the first user interface window may allow the user to create music data 120.

In an operation 202, musical notes are read, for example, after opening the musical data file or by interpreting the created music data 120. In an operation 204, the musical note sequence read from the musical data file is presented in display 118 or played through speaker 118, musical instrument 130, or music synthesizer 132.

In an operation 206, one or more indicators indicating critical beat points are received. The indicators are received by sound synthesizer application 122 based on user selection and interaction with sound synthesizer application 122. A time for each critical beat point is captured relative to the time in the presentation of the sequence of musical notes 300. For example, with reference to FIG. 3, a sequence of musical notes 300 may be presented in display 118. Sound synthesizer application 122 may provide a user interface window in which the user may position the critical beat points relative to the sequence of musical notes 300. As an example, a user may use mouse 112 to select the timing position for each critical beat point by pointing and clicking in display 118 as understood by a person of skill in the art.

As another alternative, the sequence of musical notes 300 may be presented by playing the sequence of musical notes 300 read from the selected musical data file using speaker 118, musical instrument 130, or music synthesizer 132. Of course, the sequence of musical notes 300 also may be played and presented in display 118. The user may use mouse 112 to select the timing position for each critical beat point by clicking at the desired time during the playing of the sequence of musical notes 300.

A critical beat point may be determined by the user as a tempo-independent position in musical time and indicates a level of importance associated with one or more adjacent musical notes. For example, the most consistent use of dynamic variation is to isolate notes critical to define a simple core beat. It is desirable to play a more robust pattern than is required to define the beat, yet the beat needs to remain clearly distinct to support the music. Beat points are the note positions that define the core beat, which remain distinct and isolated. Beat points can also vary in degree. For example, in older styles of popular music, the beat is often nothing more than the count: 1, 2, 3, 4. In later styles, count "3" is often dropped or subdued. In the old song "Suzy Q" you find that count 1 is defined, count 2 is very profound, count 3 is defined very little (if at all), and count 4 is lightly defined (the back beat, counts 2 and 4, are typically critical to the beat in almost all forms of popular music). The beat in Suzy Q is a moderate beat on 1, and very profound beat on 2, little or no beat on 3, and a moderate beat on 4.

Figure 3:
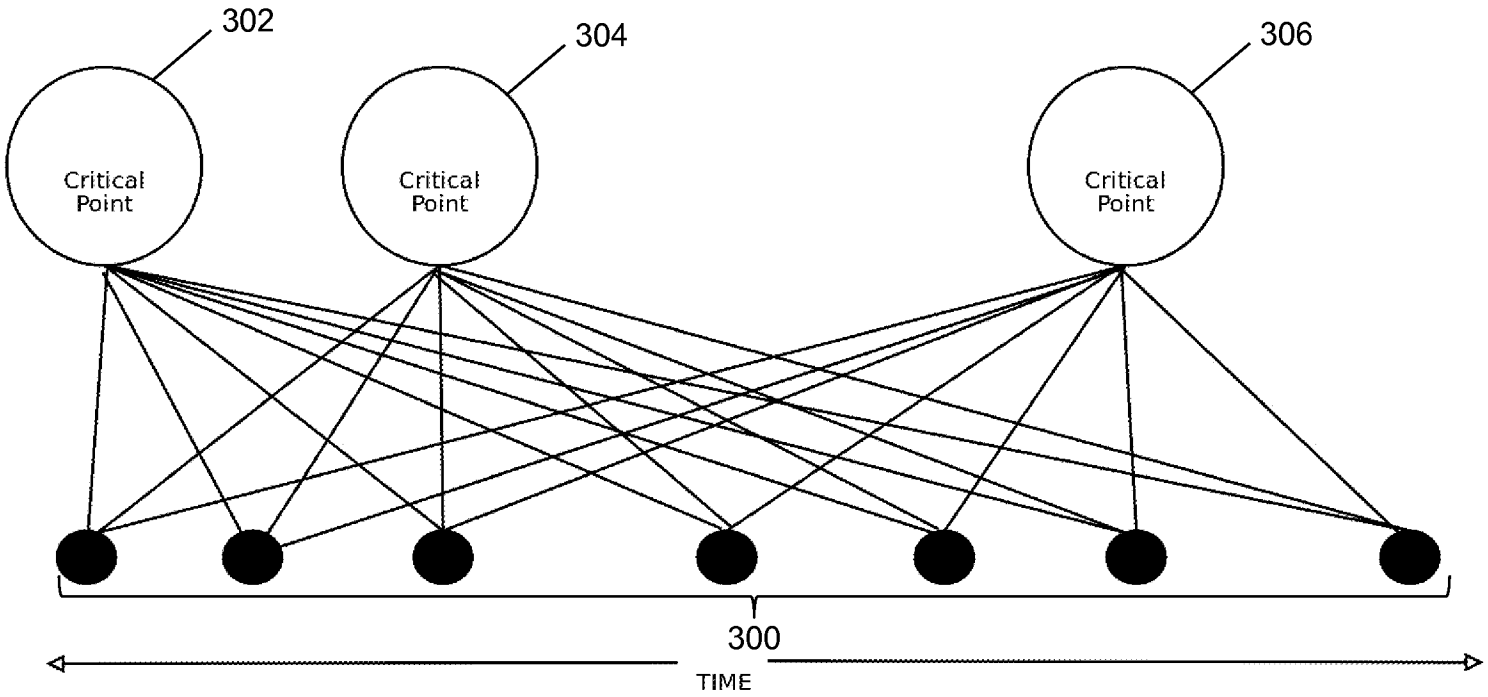
FIG. 3 depicts a sequence of musical notes and critical beat points in accordance with an illustrative embodiment.

With continuing reference to FIG. 3, a first critical beat point 302, a second critical beat point 304, and a third critical beat point 306 may be defined for the sequence of musical notes 300. The selected critical beat points may be associated with a specific note or may be defined between notes. A single group of critical beat points may be defined for all of the musical notes read from the musical data file. In this case, the sequence of musical notes 300 includes all of the musical notes read from the musical data file. Alternatively, the musical notes read from the musical data file may be subdivided into subsets of notes by the user through interaction with a user interface window presented under control of sound synthesizer application 122. Thus, the sequence of musical notes 300 may be one of the subsets of notes.

In an operation 208, one or more indicators indicating a period for note isolation are received. For example, a single period for note isolation may be defined by the user using a user interface such as a numerical entry text box presented under control of sound synthesizer application 122 in display 118. The period for note isolation is a fixed period. In an illustrative embodiment, the affect is logarithmic so the period for note isolation may be expressed as a half life. As another example, the user may identify one or more time periods during the play of the sequence of musical notes 300 and during which a value of the period for note isolation is defined. Thus, more than one period for note isolation may be defined for the sequence of musical notes 300. The value for each time period may be defined differently. In an alternative embodiment, the period for note isolation may be implemented as two parameters for notes preceding or following a critical beat point.

In an operation 210, an instrument type indicator indicating the type of musical instrument to be used to present the sequence of musical notes 300 is received. For example, a list of musical instrument types may be presented to the user in display 118 under control of sound synthesizer application 122. The instrument indicator is received based on the user selection from the list.

In an operation 212, a velocity coefficient is calculated for each note of the sequence of musical notes 300 using the period for note isolation and the critical beat points. For example, the velocity coefficient for a given note may be calculated using the equation, $$\sum_{i=1}^{N}\left(1-\frac{W}{D}\right),$$

where N is the number of critical beat points, W is the period for note isolation, and D is the note's distance in time from each critical beat point. As another example, the velocity coefficient for a given note may be calculated using the equation, $$\sum_{i=1}^{N}\left(1-\frac{W}{D}\right)^2.$$

It the sequence of musical notes 300 is a subset of the notes read from the musical data file, the velocity coefficient is calculated based on the period for note isolation and the note's distance in time from each critical beat point defined for that subset. Other equations for calculating the velocity coefficient using the period for note isolation and the note's distance in time from each critical beat point may be used.

Using the velocity coefficient calculated for each note, the velocities of the notes that do not correspond to beat points vary with proximity to the beat point. Specifically, the note is quieter when nearer to a beat point and is gradually louder away from the beat point. The time around each beat point in which non-beat notes are reduced is defined as the period for note isolation and is fixed and thus does not vary with tempo. The period for note isolation is used to sufficiently isolate a note that corresponds to a beat point. More time results in a bland drum pattern. Less time buries the beat points and sounds too busy or even artificial. Because the time required to sufficiently isolate a note is fixed, the velocities relevant to the beat points cannot be determined without knowing the tempo at which the note pattern is to be played. Velocities calculated for a pattern at a specific tempo may be adjusted to sound correct if the pattern is played at a different tempo.

In an operation 214, a velocity to play each note is determined based on the calculated velocity coefficient for each note. For example, if determining a musical instrument digital interface (MIDI) note velocity, values from 0 to 255 are used for inclusion in a MIDI message as understood by a person of skill in the art. In this example, the velocity may be determined by multiplying the velocity coefficient for each note by 255. Of course, other scaling factors may be used. For example, the user may select the scaling factor as an input similar to the period of note isolation. As an example, a conversion to a logarithmic value may be used as a scaling factor.

In an operation 216, the sequence of musical notes 300 is played using the determined velocity. For example, MIDI messages including the determined velocity may be sent to musical instrument 130 or music synthesizer 132 or generated by sound synthesizer application 122 and played through speaker 118 as understood by a person of skill in the art. Reducing the velocity of notes that do not correspond to beat points to isolate them gradually and using a time window that may vary with the intensity of the beat point but not the tempo allows note patterns to be generated by a computer as basically structured patterns of notes played in an aesthetically pleasing manner at any tempo. This in turn allows the computer to generate random variations in note patterns such as drum patterns. Without this capability, tossing random variations into a note pattern risks disturbing the "feel" of it. As another benefit, correctly adjusting the velocities, including possible discarding or skipping of notes beneath a threshold, with respect to tempo causes note patterns to be much more useful. For example, many variations in drum parts, and even variations considered to represent different styles, prove to be little more than an appropriate compensation for the same basic pattern played at a faster or slower tempo. As a simple example, a kind of "boogie" swing beat used in old blues typically as low as 100 beats/minute (BPM) becomes a typical fox trot when it is played at 125 BPM or more and recalculated factoring in tempo.

The velocity provides a level to play each note based on the tempo in the sequence of musical notes 300 to simulate the way a human might accent the notes and to provide an aesthetically pleasing sound based on the individual user's perception of the sound. As a result, in an operation 218, the user may determine that the sound produced from speaker 118, musical instrument 130, or music synthesizer 132 is unsatisfactory or is satisfactory. If the produced sound is unsatisfactory to the user, processing may continue at any of operations 206-210 to allow adjustment of the parameters used to calculate the velocity. If the produced sound is satisfactory to the user, the velocity data may be stored to computer readable medium 108. For example, the velocity coefficient and/or the velocity may be stored in the same or a different file than the musical data file from which the sequence of musical notes 300 were read. Additionally, one or more of the adjustment parameters may be stored also or in the alternative to allow recreation of the sound created in operation 216.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A non-transitory computer-readable medium having stored thereon computer-readable instructions that when executed by a device cause the device to:

control a first presentation of a sequence of musical notes;

receive a critical beat indicator defining a time within the sequence of musical notes for a critical beat point;

receive a period for note isolation indicator defining a period for note isolation for the sequence of musical notes;

calculate a velocity coefficient for each note of the sequence of musical notes, wherein the velocity coefficient is calculated as a function of the defined time and the defined period for note isolation; and control a second presentation of the sequence of musical notes using the calculated velocity coefficient for each note of the sequence of musical notes.

2. The computer-readable medium of claim 1, wherein the computer-readable instructions are further configured to receive a musical instrument type indicator defining a type of musical instrument on which the sequence of musical notes is presented, wherein the sequence of musical notes are presented in the second presentation based on the defined type of musical instrument.

3. The computer-readable medium of claim 1, wherein the first presentation is presented using a display.

4. The computer-readable medium of claim 3, wherein the critical beat indicator is received as a result of interaction with the display.

5. The computer-readable medium of claim 1, wherein the first presentation is presented using at least one of a musical instrument, a musical synthesizer, and a speaker.

6. The computer-readable medium of claim 5, wherein the critical beat indicator is received as a result of interaction with an input interface device while the first presentation is presented.

7. The computer-readable medium of claim 1, wherein the computer-readable instructions are further configured to:

receive a request from a user via a user interface window presented in a display accessible by the device, wherein the request indicates a data file to open, wherein the data file includes data characterizing the sequence of musical notes; and read musical notes from the indicated data file.

8. The computer-readable medium of claim 7, wherein the sequence of musical notes is a subset of the musical notes read from the indicated data file.

9. The computer-readable medium of claim 8, wherein a critical beat indicator is received for each subset of the musical notes read from the indicated data file.

10. The computer-readable medium of claim 9, wherein a plurality of critical beat indicators is received for each subset of the musical notes read from the indicated data file.

11. The computer-readable medium of claim 7, wherein the sequence of notes is all of the musical notes read from the indicated data file.

12. The computer-readable medium of claim 11, wherein a plurality of critical beat indicators is received for the sequence of musical notes.

13. The computer-readable medium of claim 1, wherein the velocity coefficient for each note of the sequence of musical notes is calculated using the equation, $$\sum_{i=1}^{N}\left(1-\frac{W}{D}\right),$$

where N is a number of critical beat points, W is the period for note isolation, and D is each note's distance in time from each critical beat point.

14. The computer-readable medium of claim 1, wherein the second presentation is presented using at least one of a musical instrument, a musical synthesizer, and a speaker.

15. The computer-readable medium of claim 1, wherein the computer-readable instructions are further configured to store the calculated velocity coefficient for each note of the sequence of musical notes in the computer readable medium.

16. The computer-readable medium of claim 1, wherein the computer-readable instructions are further configured to determine a velocity to play each note of the sequence of musical notes using the velocity coefficient for each note of the sequence of musical notes, wherein the sequence of musical notes are presented using the determined velocity for each note of the sequence of musical notes.

17. The computer-readable medium of claim 16, wherein the velocity for each note of the sequence of musical notes is determined by multiplying the calculated velocity coefficient for each note of the sequence of musical notes by a scaling factor.

18. A system comprising:

a processor;

a music presenting device operably coupled to the processor; and a computer-readable medium operably coupled to the processor, the computer-readable medium having computer-readable instructions stored thereon that, when executed by the processor, cause the system to control a first presentation of a sequence of musical notes;

receive a critical beat indicator defining a time within the sequence of musical notes for a critical beat point;

receive a period for note isolation indicator defining a period for note isolation for the sequence of musical notes;

calculate a velocity coefficient for each note of the sequence of musical notes, wherein the velocity coefficient is calculated as a function of the defined time and the defined period for note isolation; and control a first presentation of the sequence of musical notes by the music presenting device using the calculated velocity coefficient for each note of the sequence of musical notes.

19. A method of adjusting a presentation of music, the method comprising:

controlling presentation of a sequence of musical notes by a first music presenting device;

receiving a critical beat indicator defining a time within the sequence of musical notes for a critical beat point;

receiving an isolation indicator defining a period for note isolation for the sequence of musical notes;

calculating, by a processor, a velocity coefficient for each note of the sequence of musical notes, wherein the velocity coefficient is calculated as a function of the defined time and the defined period for note isolation; and controlling presentation of the sequence of musical notes by a second music presenting device using the calculated velocity coefficient for each note of the sequence of musical notes.

20. The method of claim 19, wherein the first music presenting device and the second music presenting device are one or more of:

a musical instrument;

a display;

a musical synthesizer;

a speaker.

* * * * *